US010040661B2

(12) United States Patent
Yoshida

(10) Patent No.: US 10,040,661 B2
(45) Date of Patent: Aug. 7, 2018

(54) IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/416,350

(22) Filed: Jan. 26, 2017

(65) Prior Publication Data

US 2017/0219982 A1 Aug. 3, 2017

(30) Foreign Application Priority Data

Jan. 28, 2016 (JP) ..... 2016-014786

(51) Int. Cl.
*B65H 31/20* (2006.01)
*B65H 31/26* (2006.01)
*B65H 31/36* (2006.01)

(52) U.S. Cl.
CPC ..... *B65H 31/20* (2013.01); *B65H 31/26* (2013.01); *B65H 31/36* (2013.01); *B65H 2402/31* (2013.01); *B65H 2405/1117* (2013.01); *B65H 2405/1124* (2013.01); *B65H 2405/111646* (2013.01)

(58) Field of Classification Search
CPC .... B65H 31/20; B65H 31/36; B65H 2402/31; B65H 2405/111646; B65H 2405/1117; B65H 2405/1124; B65H 31/26
See application file for complete search history.

(56) References Cited

U.S. PATENT DOCUMENTS 8,348,263 B2 * 1/2013 Otani ..... B65H 31/20 271/207
8,424,871 B2 * 4/2013 Ino ..... B65H 31/20 271/220
8,430,399 B1 * 4/2013 Huang ..... B65H 1/04 271/171
9,242,827 B2 * 1/2016 Niimura ..... B65H 31/22
9,630,788 B2 * 4/2017 Horita ..... B65H 1/00

FOREIGN PATENT DOCUMENTS

JP 2009-137719 A 6/2009

* cited by examiner

*Primary Examiner* — Jeremy R Severson
(74) *Attorney, Agent, or Firm* — Studebaker & Brackett PC

(57) ABSTRACT

An image forming apparatus includes a stopper member supported either in a storage posture stored in a storage part by turning in an upstream side or a restriction posture to prevent falling down of a sheet from a sheet stacking face by turning in a downstream side. The storage part has a first recess and a second recess deeper than the first recess. The stopper member has a pressed part supported in the second recess movably upward and downward and a main part supported in the first recess in the storage posture. When the pressed part is pressed downward in the storage posture, the pressed part is moved downward and the main part comes into contact with a downstream side edge of the first recess, the stopper member is turned around the downstream side edge into the restriction posture through a protrusion posture protruding above the sheet stacking face.

10 Claims, 8 Drawing Sheets

IMAGE FORMING APPARATUS

INCORPORATION BY REFERENCE

This application is based on and claims the benefit of priority from Japanese Patent Application No. 2016-014786 filed on Jan. 28, 2016, which is incorporated by reference in its entirety.

BACKGROUND

The present disclosure relates to an image forming apparatus having an ejection tray on which a sheet with a formed image is ejected.

In an image forming apparatus, such as a printer and a multifunctional peripheral, a sheet on which an image has been formed is ejected on an ejection tray through an ejection port. The ejection tray has a size capable of receiving a maximum size sheet. However, when reduction in size of the image forming apparatus is promoted, the size of the ejection tray is reduced into a minimum size capable of receiving the maximum size sheet. Then, a nonstandard size long sheet may fall from the ejection tray depending on an ejecting condition of the sheet.

In addition, depending on type (for example, a thickness of the sheet) of the sheet and installation environment (for example, humidity) of the image forming apparatus, the sheet on which an image has been formed may be ejected with the front portion thereof curled. In this case, an ejection position of the sheet on the ejection tray may be displaced to cause stock failure of the ejected sheet. Alternatively, the sheet may fall from the ejection tray depending on the curl condition.

Therefore, the image forming apparatus may be provided with a stopper member which is supported on the ejection tray in an upward inclined posture toward a downstream side in a sheet ejection direction so as to prevent the ejected sheet from falling down from the ejection tray. The stopper member has a shaft rotatably supported on the ejection tray and a pressed part on the downstream side from the shaft. When the pressed part is pressed downward with a user's finger, the stopper member is turned around the shaft and an upstream side portion of the stopper member from the shaft is floated above the ejection tray. Then, the user puts his finger in a space between the floated portion of the stopper member and the ejection tray and then turns the stopper member around the shaft. This makes the stopper member be turned in the upward inclined posture as described above.

SUMMARY

In accordance with an embodiment of the present disclosure, an image forming apparatus includes an ejection tray, a storage part and a stopper member. The ejection tray has a sheet stacking face on which an ejected sheet is stacked. The storage part is formed in the sheet stacking face. The stopper member is provided in the storage part turnably around a proximal end of the stopper member in upstream and downstream sides in a sheet ejection direction. The stopper member has a base end part and a main part extending from the base end part toward a distal end of the stopper member. The stopper member is selectively supported either in a storage posture stored in the storage part to form a part of the sheet stacking face by turning in the upstream side or a restriction posture to prevent the sheet from falling down from the sheet stacking face by turning in the downstream side. The storage part has a first recess and a second recess. The second recess is connected to an end on the downstream side of the first recess with a step. The second recess has a depth deeper than a depth of the first recess. The stopper member has a pressed part and a main part. The pressed part is provided in the proximal end. The pressed part is supported in the second recess so as to be movable upward and downward and turnable. The base end part of the stopper member is supported in the second recess so as to be movable upward and downward. The main part of the stopper member is supported in the first recess in the storage posture. The main part extends from the pressed part toward a distal end of the stopper member. The main part is supported in the first recess in the storage posture. When the pressed part is pressed downward in the storage posture, the pressed part is moved downward in the second recess and an lower face of the main part comes into contact with an edge on the downstream side of the first recess, the stopper member is turned around the edge into a protrusion posture where the distal end protrudes above the sheet stacking face.

In the image forming apparatus accordance with the embodiment of the present disclosure, the pressed part of the stopper member may have an engagement part. The second recess of the storage part may have an engaged part to which the engagement part is supported so as to be movable upward and downward and rotatable.

In the image forming apparatus accordance with the embodiment of the present disclosure, the engagement part may be a guide projection projecting in a sheet width direction perpendicular to the sheet ejection direction. The engaged part may be a vertical guide groove with which the guide projection is engaged.

In the image forming apparatus accordance with the embodiment of the present disclosure, when the stopper member is turned from the protrusion posture into the restriction posture, the guide projection may be moved upward in the guide groove and then engaged with an upper end of the guide groove so that the stopper member is supported in the restriction posture.

In the image forming apparatus accordance with the embodiment of the present disclosure, the second recess may have a guide part on a bottom face of the second recess. The guide part may have an inclined face upward toward the upstream side. When the pressed part is pressed downward in the protrusion posture, an end edge on the downstream side of the pressed part comes in contact with the inclined face. When the stopper member is turned from the protrusion posture into the restriction posture, the end edge of the pressed part is guided along the inclined face toward the upstream side.

In the image forming apparatus accordance with the embodiment of the present disclosure, the second recess may have a latch mechanism which has a projecting part projectable toward the upstream side and is alternatively switchable into a first state where the projecting part projects by a predetermined length and into a second state where the projecting part projects by a length longer than the predetermined length, by pushing the projecting part inward. When the pressed part is pressed downward and comes in contact with the projecting part, the projecting part is pushed in to switch the latch mechanism from the first state into the second state. When the pressed part is further pressed downward lower than the projecting part, the projecting part of the latch mechanism switched into the second posture pushes the pressed part in the upstream side to turn the stopper member in the restriction posture.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
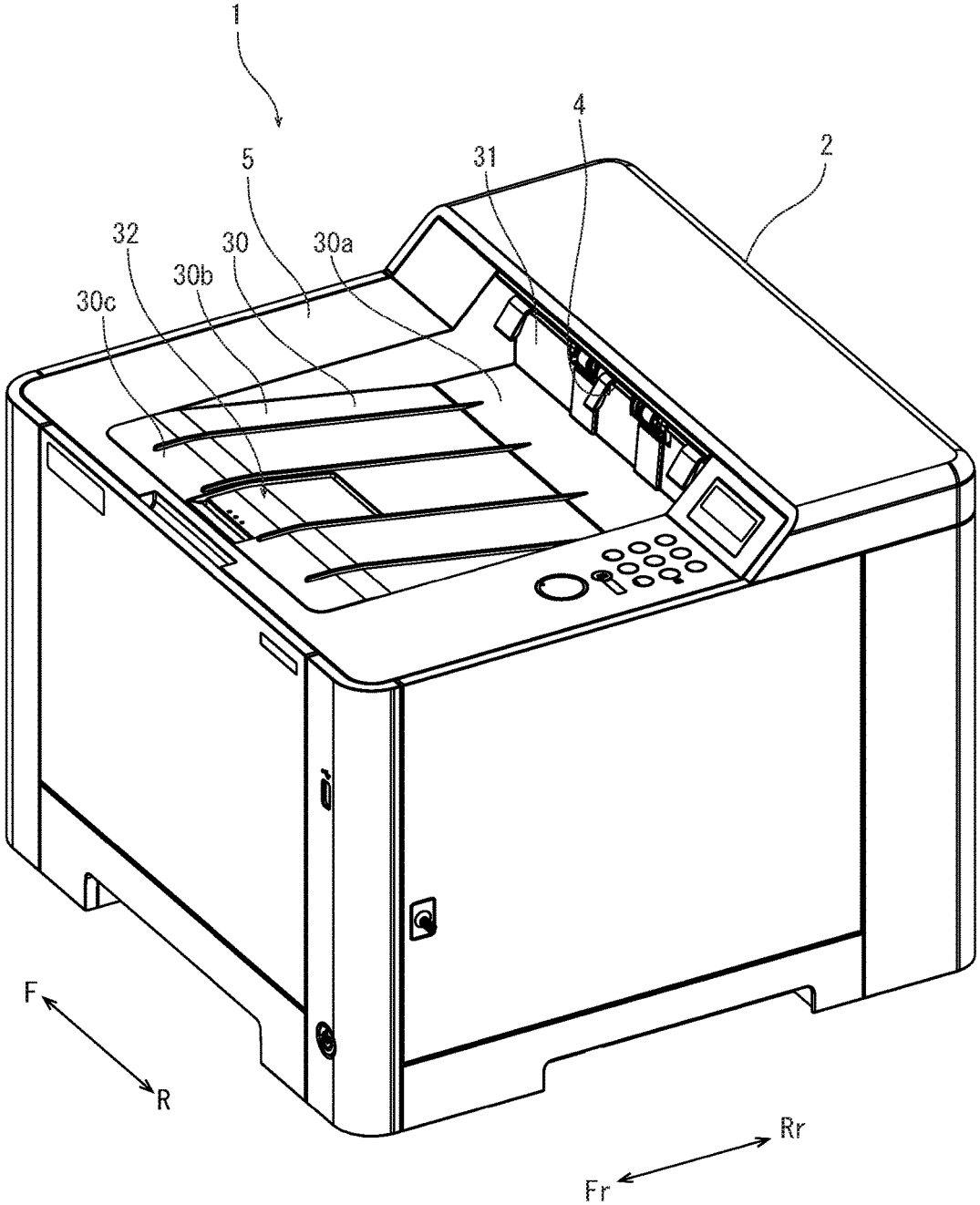
FIG. 1 is a perspective view showing a color printer according to an embodiment of the present disclosure.
Figure 2:
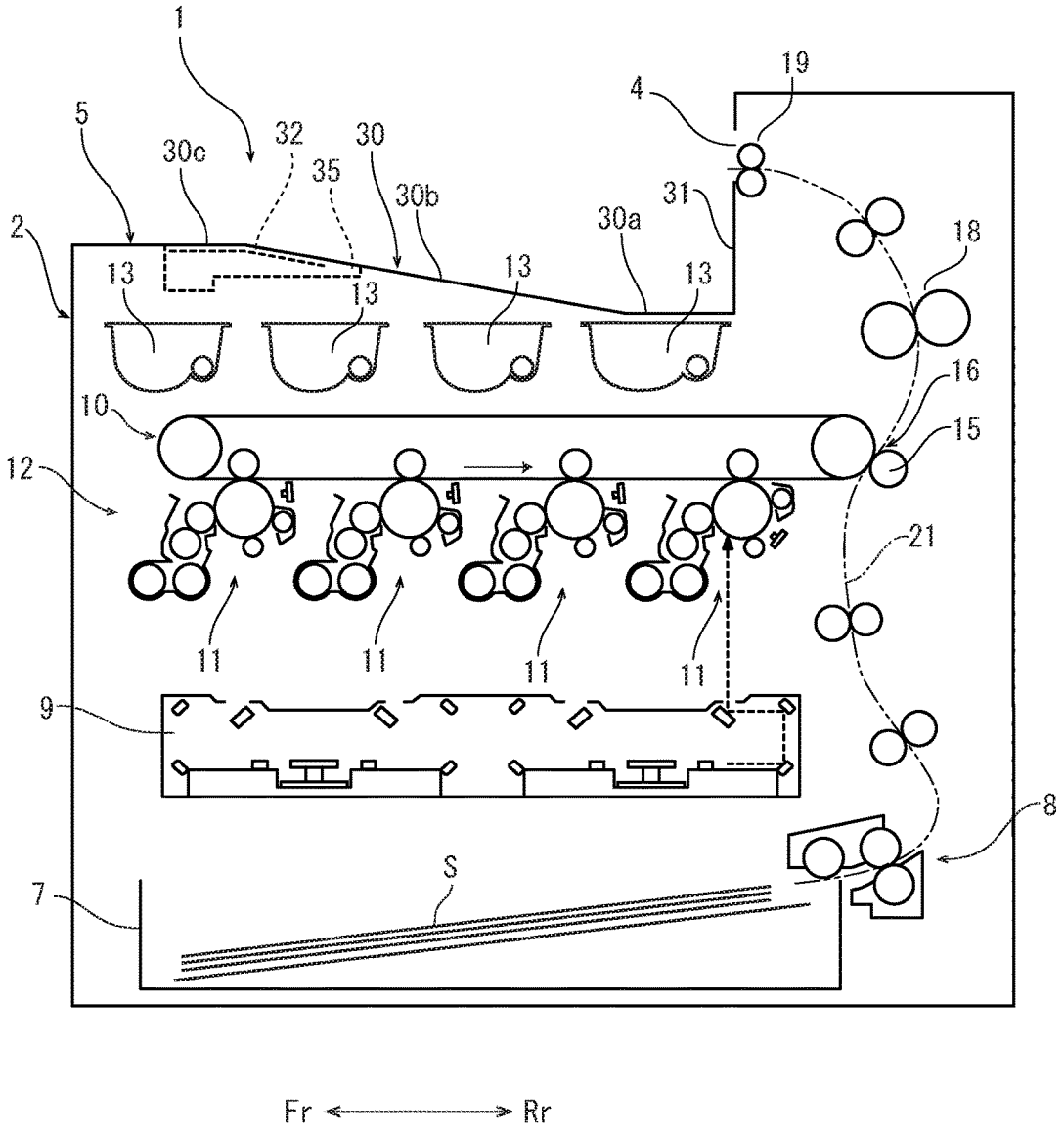
FIG. 2 is a view showing an internal structure of the color printer according to the embodiment of the present disclosure.

Firstly, with reference to FIGS. 1 and 2, an entire structure of a color printer 1 that is an example of an image forming apparatus will be described. FIG. 1 is a perspective view showing the color printer and FIG. 2 is a view schematically showing the color printer. In the following description, front and rear directions shown in FIG. 1 shows front and rear directions of the color printer 1, and left and right directions are based on a direction in which the color printer 1 is viewed from the front side.

The color printer 1 has a rectangular parallelepiped shaped apparatus main body 2. On a center portion of an upper face of the apparatus main body 2, an ejection port 4 through which a sheet with a formed image is ejected and an ejection tray 5 on which the sheet ejected from the ejection port 4 is stacked are formed. The apparatus main body 2 has a sheet feeding cassette 7 in which the sheets are stored and a sheet feeding device 8 which feeds the sheet from the sheet feeding cassette 7 at its lower portion. The apparatus main body 2 has an exposure device 9 above the sheet feeding cassette 7 and an image forming part 12 above the exposure device 9. The image forming part 12 has an intermediate transferring belt 10 supported rotatably and an image forming part 12. The image forming part 12 has four image forming units 11 and forms a full color toner image on the intermediate transferring belt 10 using toner of four colors in an electrographic manner. The image forming units 11 are connected to toner containers 13 which contain toner of the corresponding color.

On the rear side of the intermediate transferring belt 10, a second transferring roller 15 is rotatably supported. Between the second transferring roller 15 and the intermediate transferring belt 10, a second transferring part 16 is formed. The apparatus main body 2 has a fixing device 18 above the second transferring part 16 and an ejection device 19 above the fixing device 18. The ejection device 19 is disposed inside of the ejection port 4.

In addition, the apparatus main body 2 has a conveying path 21 from the sheet feeding device 8 to the ejection device 19 through the second transferring part 16 and the fixing device 18.

Next, an operation of forming an image by the color printer 1 having such a configuration will be described. After exposure is performed by the exposure device 9 based on an image date, the image forming part 12 forms a full color toner image on the intermediate transferring belt 10. On the other hand, the sheet S fed from the sheet feeding cassette 7 by the sheet feeding device 8 is conveyed along the conveying path 21 into the second transferring part 16 in a suitable timing with the above image forming operation. At the second transferring part 16, the full color toner image on the intermediate transferring belt 10 is second-transferred on the sheet S. The sheet S on which the full color toner image has been transferred is conveyed along the conveying path 21 into the fixing device 18. At the fixing device 18, the full color toner image is fixed on the sheet S. The sheet S with the fixed full color toner image is ejected from the ejection device 19 on the ejection tray 5 through the ejection port 4.

Figure 3:
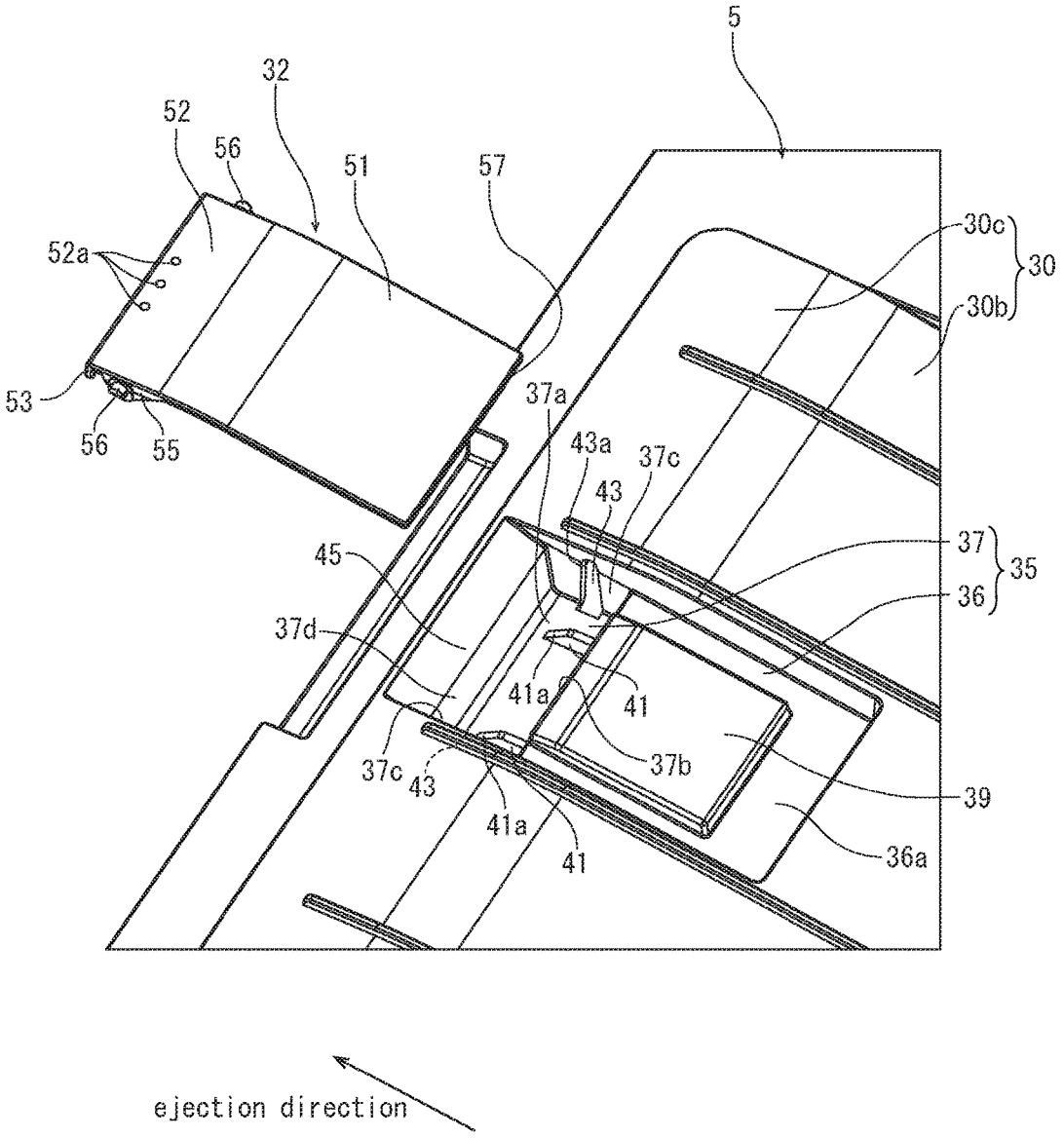
FIG. 3 is a perspective view showing an ejection tray of a first example, in the color printer according to the embodiment of the present disclosure.

Next, the ejection tray 5 of a first example will be described with reference to FIGS. 1 to 3. FIG. 3 is a disassembled perspective view showing the ejection tray. As shown in FIG. 1, the ejection tray 5 includes a sheet stacking face 30, a rear wall 31 and a stopper member 32. The sheet stacking face 30 inclines upward in a sheet ejection direction from below the ejection port 4. The rear wall 31 extends vertically between the ejection port 4 and the most upstream side end of the sheet stacking face 30 in the sheet ejection direction. The stopper member 32 is provided on the downstream side end portion of the sheet stacking face 30 and prevents the sheet from falling down from the sheet stacking face 30.

The sheet stacking face 30 has a substantial horizontal first stacking face 30*a*, an inclined face 30*b* inclined upward toward the downstream side and a substantial horizontal second face 30*c* in the order from the upstream side in the sheet ejection direction. On a boundary portion between the inclined face 30*b* and the second stacking face 30*c*, a rectangular recessed storage part 35 in which the stopper member 32 is stored is formed at a center in a sheet width direction perpendicular to the sheet ejection direction. The storage part 35 is formed in a step shape descending toward the downstream side in the sheet ejection direction. The storage part 35 has a first recess 36 formed on the inclined face 30*b* and a second recess 37 formed on the second stacking face 30*c*. The second recess 37 has a depth deeper than a depth of the first recess 36.

The first recess 36 has a substantial rectangular platform 39 on a bottom face 36*a*. The platform 39 is separated from an upstream side end face in the sheet ejection direction and both side faces in the sheet width direction of the first recess 36. An upper face of the platform 39 is formed into a flat plane lower than the sheet stacking face 30.

The second recess 37 has two guide parts 41 on a bottom face 37*a* at a predetermined interval in the sheet width direction. The two guide parts 41 are formed along the sheet ejection direction from an upstream side end face 37*b*. On a downstream side edge of each guide part 41, an inclined face 41*a* inclined upward from the bottom face 37*a* toward the upstream side is formed. In addition, the second recess 37 has guide grooves 43 (an example of an engaged part) on both side faces 37*c* in the sheet width direction. Each guide groove 43 extends from a slightly lower portion from an upper edge of the side face 37*c* to the bottom face 37*a*. A width of each guide groove 43 is to be wider downward from a curved upper end 43*a* having a circular arc shape. Furthermore, at a corner between a downstream side end face 37*d* of the second recess 37 and the sheet stacking face 30, a supporting face 45 inclined upward toward the downstream side is formed.

The stopper member 32 has a rectangular shape capable of being stored in the storage part 35. The stopper member 32 has a distal side main part 51 capable of being stored in the first recess 36 and a proximal side pressed part 52 (a base end part) capable of being stored in the second recess 37. The main part 51 extends from the proximal side pressed part 52 toward a distal end 57 of the stopper member. The main part 51 and the pressed part 52 are crossed each other at an obtuse angle so as to respectively form a part of the inclined face 30*b* and a part of the second stacking face 30*c* of the sheet stacking face 30. On an upper face of the pressed part 52, a plurality of semispherical projections 52*a* are formed along a downstream side edge. From both side edges of the pressed part 52 in the sheet width direction, supporting pieces 55 are suspended downward. On outer faces of the supporting pieces 55, guide projections 56 (an example of an engagement part) are projected in opposing directions to each other along the sheet width direction on the same axis. The guide projections 56 are configured to engage with the guide grooves 43 of the second recess 37. One of the guide projections 56 has a tapered face at a corner between an almost half of a tip face and a circumferential face in order to make it easy to engage the guide projections 56 with the guide grooves 43. In addition, along the downstream side edge of the pressed part 52, a bent part 53 bent downward is formed.

In the ejection tray 5 having the above configuration, the stopper member 32 is selectively supported either in a storage posture or a restriction posture. In the storage posture, the stopper member 32 is turned in the upstream side direction around the guide projections 56 engaged with the guide grooves 43 and then is stored in the storage part 35. In the restriction posture, the stopper member 32 is turned in the downstream side direction until coming into contact with the supporting face 45 and is inclined upward above the sheet stacking face 30. The turning of the stopper member 32 from the storage posture into the restriction posture will be described with reference to FIGS. 4A to 5B. FIGS. 4A to 5B are sectional side views showing the stopper member during the turning.

Figure 4A:
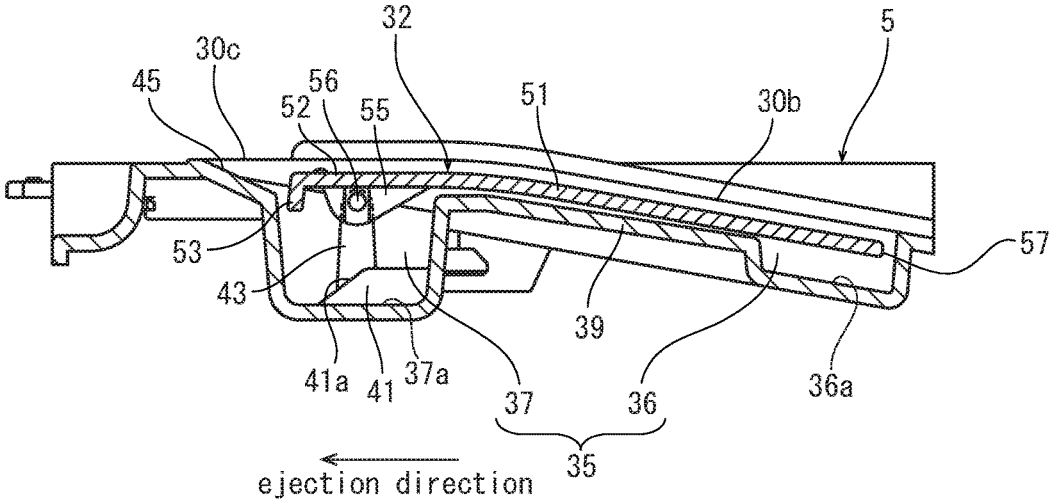
FIG. 4A is a side view showing a stopper member in a storage posture, in the ejection tray of the first example in the color printer according to the embodiment of the present disclosure.

In the storage posture, as shown in FIG. 4A, the main part 51 is placed on the platform 39 in the first recess 36 and the pressed part 52 protrudes into the second recess 37. Each guide projection 56 is engaged with the curved upper end 43*a* of each guide grooves 43.

Figure 4B:
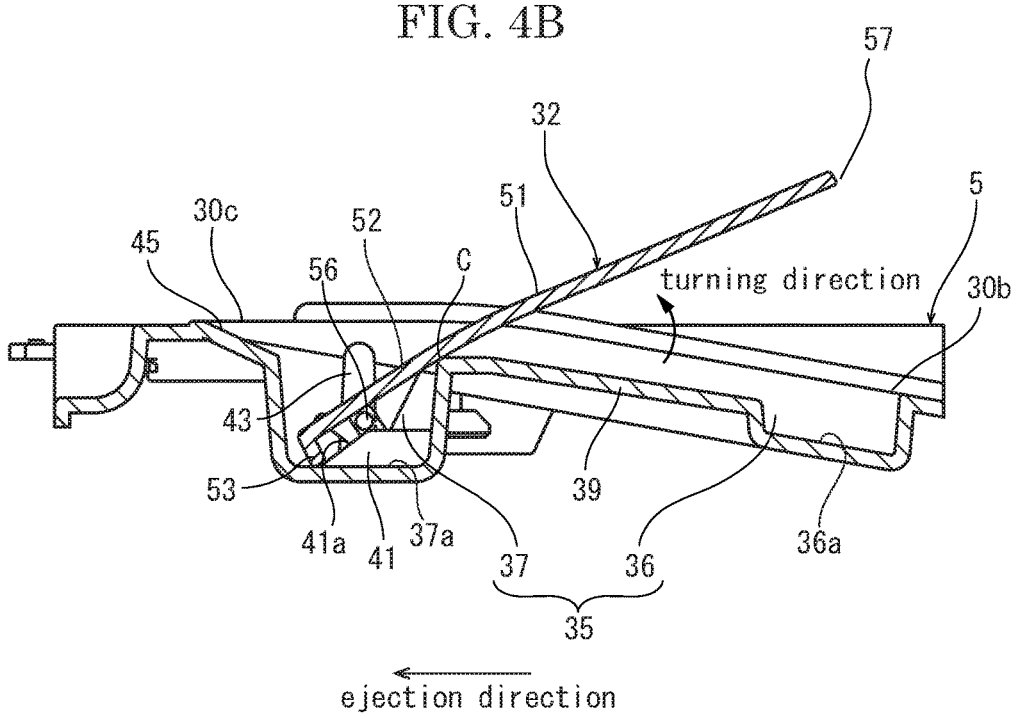
FIG. 4B is a side view showing the stopper member in a protrusion posture, in the ejection tray of the first example in the color printer according to the embodiment of the present disclosure.

When the stopper member 32 is turned into the restriction posture, the pressed part 52 is pressed downward. Then, the guide projections 56 move downward along the guide grooves 43 and then the main part 51 comes in contact with a downstream side edge C of the platform 39. In this way, the stopper member 32 is turned around the downstream side edge C of the platform 39 in the counterclockwise direction in FIG. 4B. When the pressed part 52 is pressed downward until a front edge of the bent part 53 comes into contact with the inclined faces 41*a* of the guide parts 41, the stopper member 32 is turned in a protrusion posture inclined upward toward the downstream side as shown in FIG. 4B. At this time, each guide projection 56 is moved downward until near a lower end of each guide groove 43.

Figure 5A:
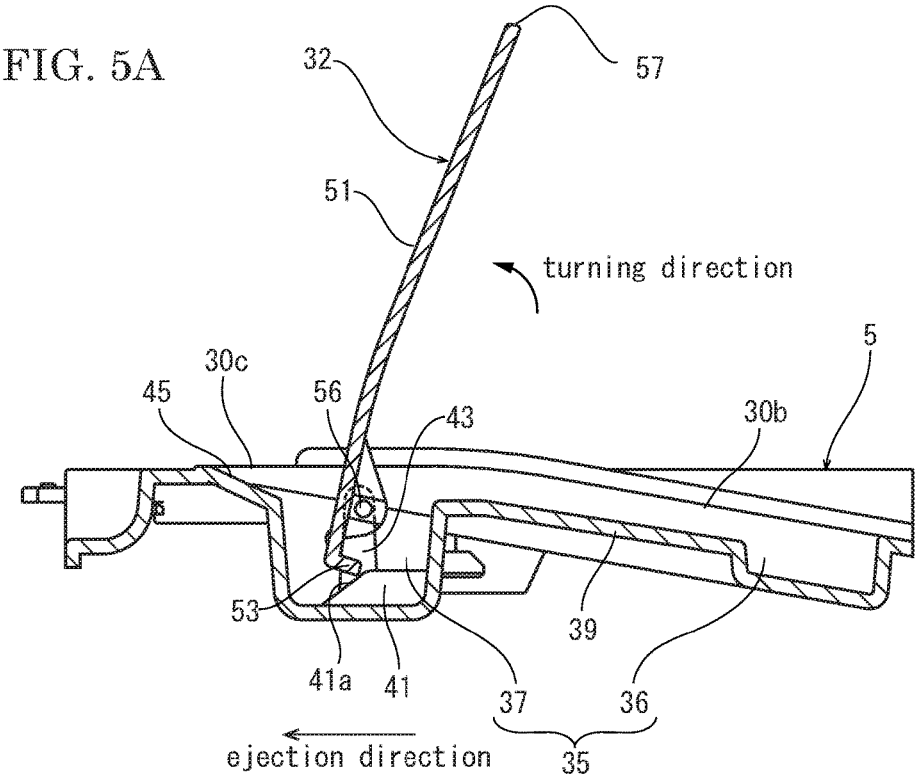
FIG. 5A is a side view showing the stopper member in a middle of a turning from the storage posture to the protrusion posture, in the ejection tray of the first example in the color printer according to the embodiment of the present disclosure.

After the stopper member 32 has been turned into the protrusion posture, a user puts his finger in a space between the platform 39 and the main part 51, and then turns the main part 51 in the counterclockwise direction in FIG. 4B. Then, as shown in FIG. 5A, the front edge of the bent part 53 is guided upward along the inclined faces 41*a* of the guide parts 41 and each guide projection 56 is moved upward in each guide groove 43. The stopper member 32 is turned around the guide projections 56 in the counterclockwise direction.

Figure 5B:
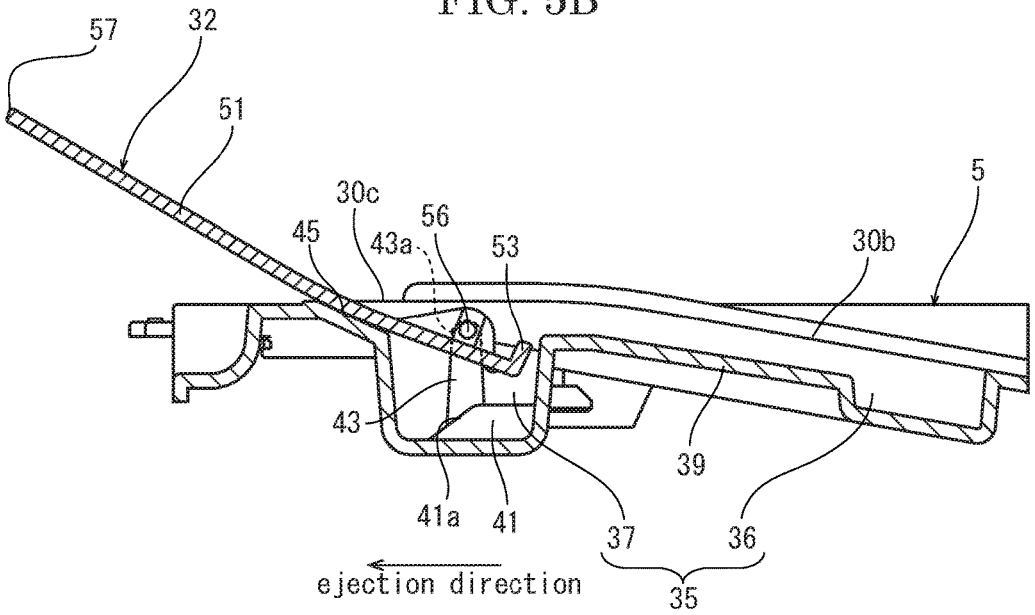
FIG. 5B is a side view showing the stopper member in a restriction posture, in the ejection tray of the first example in the color printer according to the embodiment of the present disclosure.

As shown in FIG. 5B, the stopper member 32 is turned in the restriction posture, and the main part 51 comes in contact with the supporting face 45 and each guide projection 56 is engaged with the curved upper end 43*a* of each guide groove 43. In the restriction posture, the main part 51 is supported so as to be inclined upward toward the downstream side above the sheet stacking face 30. Accordingly, if a long size sheet is ejected, a downstream side end portion of the sheet is received by the stopper member 32 so that the sheet can be prevented from falling down from the sheet stacking face 30.

As described above, according to the ejection tray 5 of the color printer 1 of the disclosure, when the pressed part 52 of the stopper member 32 is pressed downward, the main part 51 comes in contact with the downstream side edge C of the first recess 36 and then the stopper member 32 is turned around the downstream side edge C such that the main part 51 is floated above the platform 39. At this time, because a relatively large space is formed between the main part 51 and the platform 39, the user can put his finger in the space easily to facilitate the tuning of the stopper member 32.

In a conventional stopper member, it is required to press the pressed part formed on the downstream side from the shaft and to turn the stopper member around the shaft. If the pressed part has a narrow area, because it is difficult to press the pressed part deeply, a turning angle of the stopper member cannot become large and thus it is not easy to turn the stopper member 32. However, in the present disclosure, when the pressed part 52 in which the guide projections 56 are formed is pressed downward, the stopper member 32 is turned around not the guide projections 56 but the downstream side edge C of the first recess 36 after the main part 51 comes in contact with the downstream side edge C of the first recess 36 such that the stopper member 32 is floated above the first recess 36. Accordingly, even if the user has a thick finger, he can press the pressed part 52 downward with his finger deeply. Therefore, the tuning angle of the stopper member 32 can become large and then the turned main part 51 can be easily turned into the restriction posture.

In a case where the stopper member is turned around the shaft in the conventional way, if a size of the pressed part on the distal side from the shaft becomes large, it becomes possible to press the pressed part downward deeply. However, in this case, because a recess in which the pressed part is moved at the tuning of the stopper member requires a large area and a deep depth, the ejection tray 5 may increase in size. In the present disclosure, the second recess 37 in which the pressed part 52 is moved at the turning of the stopper member 32 has the same size and depth as the recess of the conventional ejection tray which is turned around the shaft. Accordingly, it becomes possible to increase the size and depth of the pressed part 52 within a limited sized recess.

In addition, when the stopper member 32 is turned into the restriction posture from the storage posture through the protrusion posture, the guide projections 56 of the stopper member 32 are guided along the guide grooves 43 of the second recess 37 upward and downward so that the stopper member 32 can be turned smoothly and stably without shaking.

In addition, although the stopper member 32 is turned from the protrusion posture into the restriction posture around the guide projections 56 which are moved upward in the guide grooves 43, the bent part 53 is guided along the inclined faces 41*a* of the guide parts 41 so that the stopper member 32 can be turned stably and smoothly. Then, the tuning of the stopper member 32 is restricted by engaging the guide projections 56 with the curved upper ends 43*a* of the guide grooves 43 so that the stopper member 32 can be supported in the restriction posture stably.

Next, the ejection tray 5 of a second example will be described with reference to FIGS. 6A to 8D. FIGS. 6A to 7C are side sectional views showing the stopper member during the turning. FIGS. 8A to 8D are perspective views showing the action of a latch mechanism.

Figure 8A:
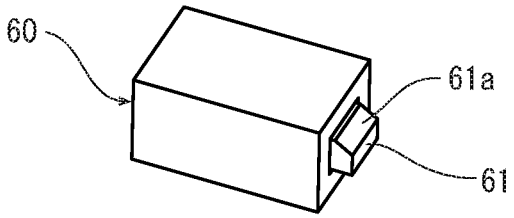
FIG. 8A is a perspective view showing a projecting part of a latch mechanism in a first projection state, in the ejection tray of the second example in the color printer according to the embodiment of the present disclosure.
Figure 8B:
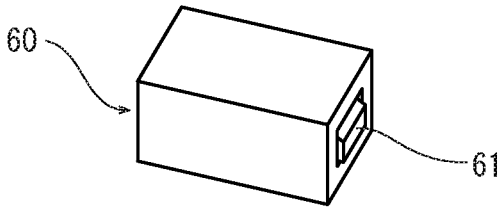
FIG. 8B is a perspective view showing the projecting part pressed inward of the latch mechanism in the first protrusion state, in the ejection tray of the second example in the color printer according to the embodiment of the present disclosure.
Figure 8C:
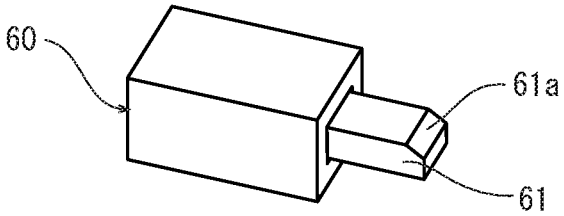
FIG. 8C is a perspective view showing the projecting part of the latch mechanism in a second projection state, in the ejection tray of the second example in the color printer according to the embodiment of the present disclosure.
Figure 8D:
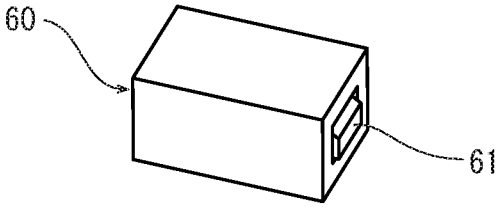
FIG. 8D is a perspective view showing the projecting part pressed inward of the latch mechanism in the second protrusion state, in the ejection tray of the second example in the color printer according to the embodiment of the present disclosure.

The ejection tray 5 of the second example includes a latch mechanism 60. As shown in FIG. 8, the latch mechanism 60 has a projecting part 61 projectable in a first projection state and a second projection state alternatively by being pushed in. A projection length of the projecting part 61 in the second protrusion state is longer than the projection length of the projecting part 61 in the first projection state. Specifically, in the first projection state shown by FIG. 8A, the projecting part 61 is pushed in (as shown in FIG. 8B) to be switch the latch mechanism 60 into the second projection state as shown in FIG. 8C. Then, in the second projection state, the projecting part 61 is pushed in (as shown in FIG. 8D) to switch the latch mechanism 60 into the first projection state (refer to FIG. 8A). The projecting part 61 has a rectangular front face. Along an upper edge of the front face, a tapered face 61*a* is formed.

Figure 6A:
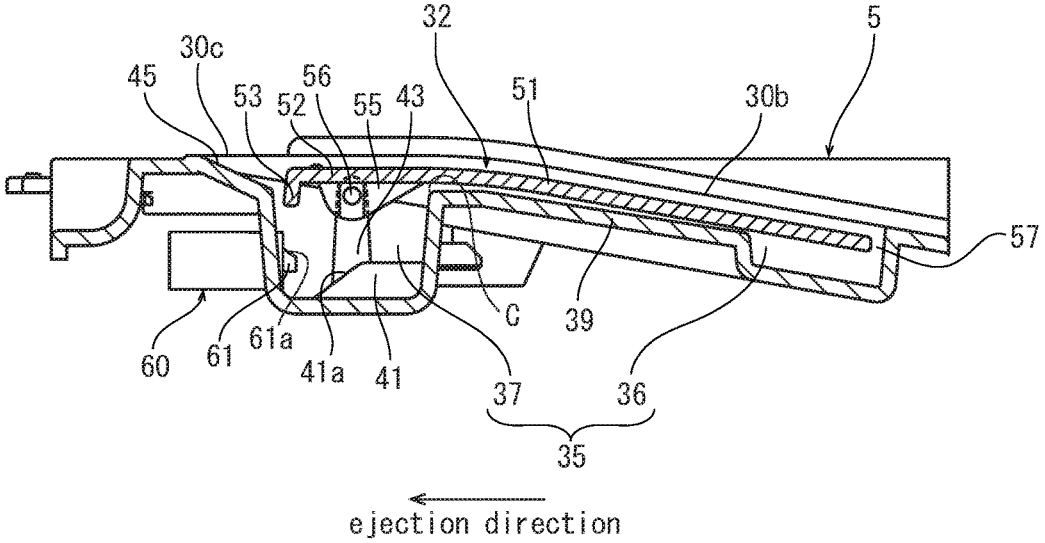
FIG. 6A is a side view showing the stopper member in the storage posture, in the ejection tray of a second example in the color printer according to the embodiment of the present disclosure.

The latch mechanism 60 is supported in a lower portion of the downstream side end face 37*d* of the second recess 37 with the projecting part 61 facing the upstream side as shown in FIG. 6A. The projecting part 61 is positioned so as to be lower than the guide projections 56 of the stopper member 32 which is turned until the front edge of the bent part 53 comes in contact with the inclined faces 41*a* of the guide parts 41.

In the storage posture, as shown in FIG. 6A, the latch mechanism 60 is switched into the first projection state.

Figure 6B:
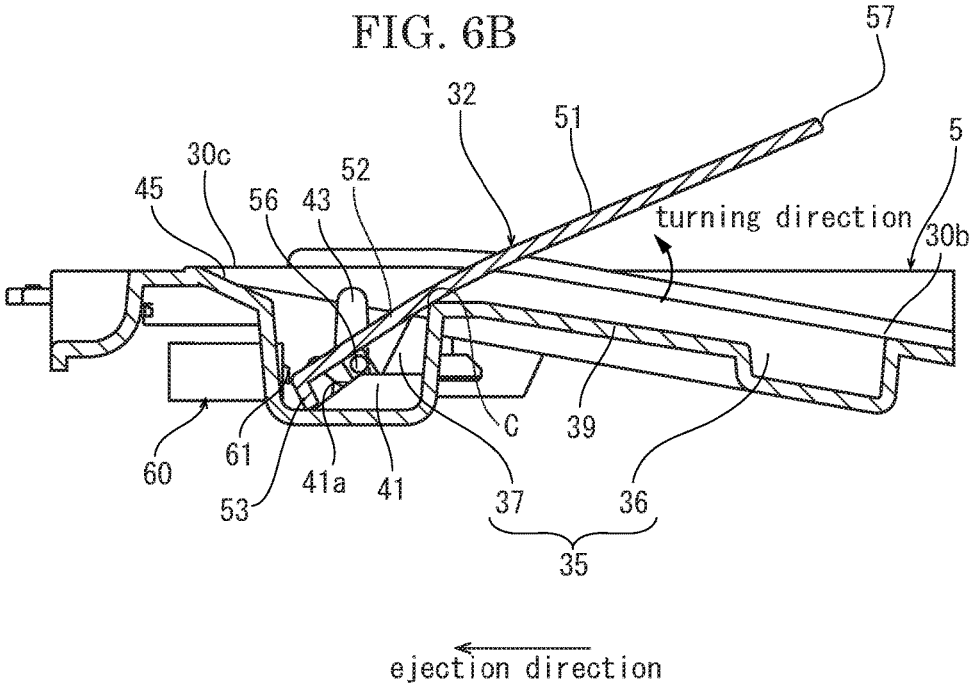
FIG. 6B is a side view showing the stopper member in the protrusion posture, in the ejection tray of the second example in the color printer according to the embodiment of the present disclosure.

When the pressed part 52 is pressed downward, the guide projections 56 are guided downward along the guide grooves 43, the outer face of the main part 51 comes in contact with the downstream side edge C of the first recess 36 and then the stopper member 32 is turned around the downstream side edge C in the counterclockwise direction in FIG. 6B. When the stopper member 32 is tuned into the protrusion posture, the front edge of the bent part 53 comes in contact with the inclined faces 41*a* of the guide parts 41. At the same time, the front edge of the bent part 53 comes in contact with the tapered face 61*a* of the projecting part 61 of the latch mechanism 60 and then pushes the projecting part 61 inward.

Figure 7A:
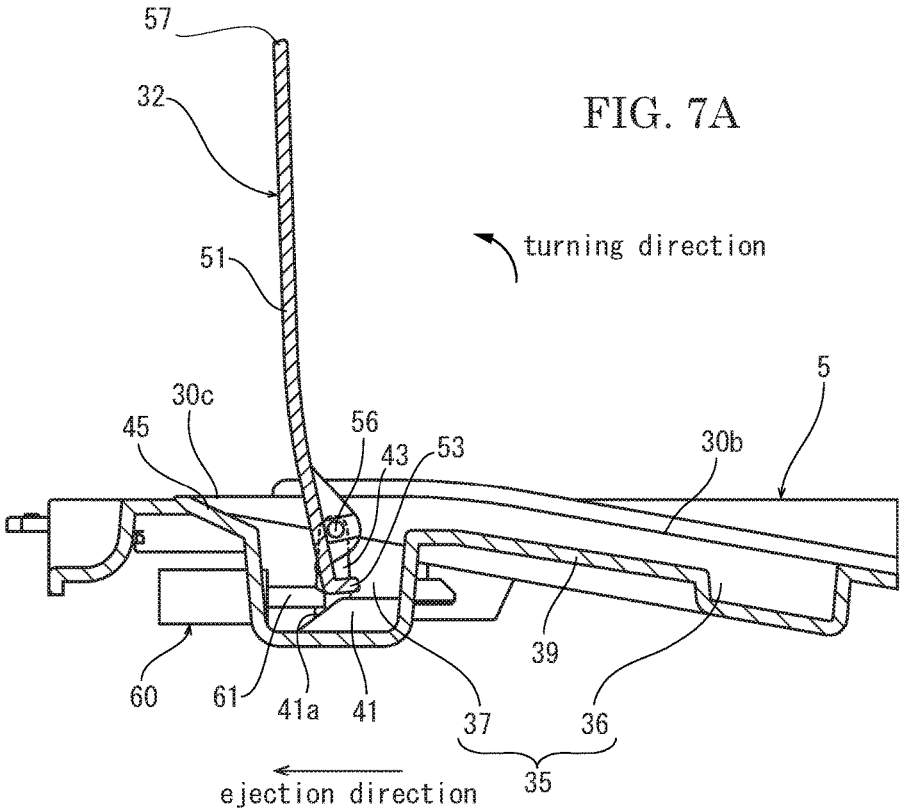
FIG. 7A is a side view showing the stopper member in the middle of the tuning from the storage posture to the protrusion posture, in the ejection tray of the second example in the color printer according to the embodiment of the present disclosure.
Figure 7B:
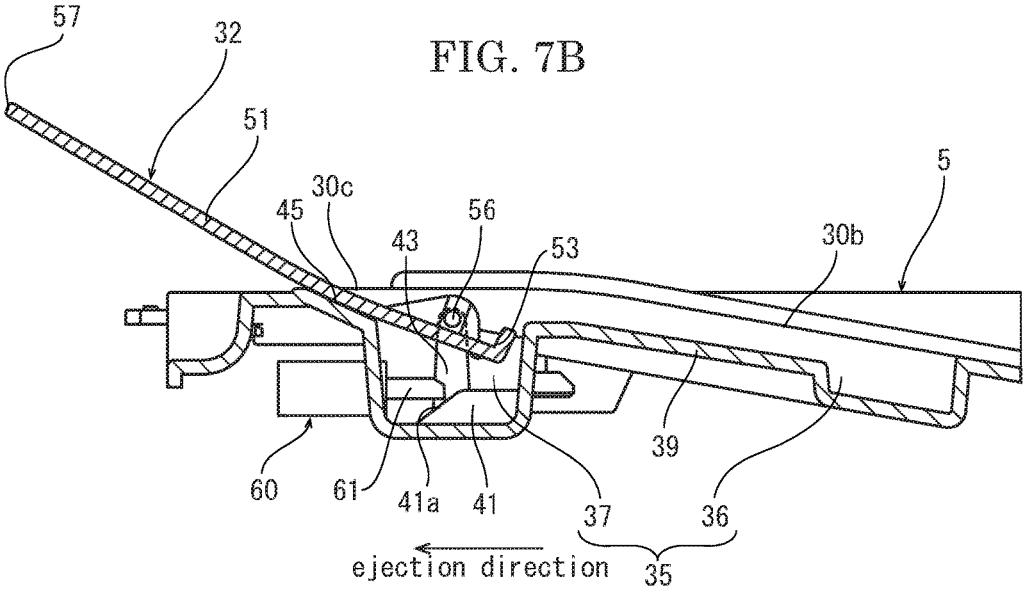
FIG. 7B is a side view showing the stopper member in the restriction posture, in the ejection tray of the second example in the color printer according to the embodiment of the present disclosure.

When the projecting part 61 is pushed inward, the latch mechanism 60 is switched into the second projection state, and as shown in FIG. 7A, the projecting part 61 pushes the downstream side portion from the guide projections 56 of the pressed part 52 toward the upstream side. Then, the front edge of the bent part 53 is automatically guided along the inclined faces 41*a* of the guide parts 41 upward and then the guide projections 56 are moved upward along the guide grooves 43. Afterward, the main part 51 is automatically turned around the guide projections 56 in the downstream direction and is supported in the restriction posture (refer to FIG. 7B).

In turning the stopper member 32 supported in the restriction posture into the storage posture, when the stopper member 32 is turned toward the upstream side, the downstream side end portion of the pressed part 52 or the bent part 53 comes into contact with the projecting part 61 (refer to FIG. 7A). Afterward, when the stopper member 32 is turned around the guide projections 56 which are moved downward in the guide grooves 43, the projecting part 61 is pushed inward by the downstream side end portion of the pressed part 52 or the bent part 53 (refer to FIG. 6B) and then the latch mechanism 60 is switched into the first projection state (refer to FIG. 6A).

As described above, according to the second example, only pushing the pressed part 52 downward is required to turn the stopper member 32 from the protrusion posture to the restriction posture automatically. This more facilitates the turning of the stopper member.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

What is claimed is:

1. An image forming apparatus comprising:

an ejection tray having a sheet stacking face on which an ejected sheet is stacked;

a storage part formed in the sheet stacking face; and a stopper member which has a base end part and a main part extending from the base end part toward a distal end of the stopper member, provided in the storage part turnably around a proximal end of the stopper member in upstream and downstream sides in a sheet ejection direction, the stopper member being selectively supported either in a storage posture stored in the storage part to form a part of the sheet stacking face by turning in the upstream side or a restriction posture to prevent the sheet from falling down from the sheet stacking face by turning in the downstream side, wherein the storage part includes a first recess; and a second recess connected to an end on the downstream side of the first recess with a step and having a depth deeper than a depth of the first recess, the base end part of the stopper member supported in the second recess so as to be movable upward and downward and turnable; and the main part of the stopper member extending from the base end part toward the distal end of the stopper member and supported in the first recess in the storage posture, wherein when the base end part is pressed downward in the storage posture, the base end part is moved downward in the second recess and a lower face of the main part comes into contact with an edge on the downstream side of the first recess, the stopper member is turned around the edge into a protrusion posture where the distal end protrudes above the sheet stacking face, wherein the base end part of the stopper member has an engagement part, and the second recess of the storage part has an engaged part to which the engagement part is supported so as to be movable upward and downward and rotatable, wherein the engagement part includes a guide projection projecting in a sheet width direction perpendicular to the sheet ejection direction, and the engaged part includes a vertical guide groove with which the guide projection is engaged.

2. The image forming apparatus according to claim 1, wherein when the stopper member is turned from the protrusion posture into the restriction posture, the guide projection is moved upward in the guide groove and then engaged with an upper end of the guide groove so that the stopper member is supported in the restriction posture.

3. The image forming apparatus according to claim 2, wherein the second recess has a guide part on a bottom face of the second recess, the guide part having an inclined face upward toward the upstream side, wherein when the base end part is pressed downward in the protrusion posture, an end edge on the downstream side of the base end part comes in contact with the inclined face and when the stopper member is turned from the protrusion posture into the restriction posture, the end edge of the base end part is guided along the inclined face toward the upstream side.

4. The image forming apparatus according to claim 2, wherein the second recess has a latch mechanism which has a projecting part projectable toward the upstream side and is alternatively switchable into a first state where the projecting part projects by a predetermined length and into a second state where the projecting part projects by a length longer than the predetermined length, by pushing the projecting part inward, wherein when the base end part is pressed downward and comes in contact with the projecting part, the projecting part is pushed in to switch the latch mechanism from the first state into the second state, and when the base end part is further pressed downward lower than the projecting part, the projecting part of the latch mechanism switched into the second posture pushes the base end part in the upstream side to turn the stopper member in the restriction posture.

5. The image forming apparatus according to claim 1, wherein the second recess has a guide part on a bottom face of the second recess, the guide part having an inclined face upward toward the upstream side, wherein when the base end part is pressed downward in the protrusion posture, an end edge on the downstream side of the base end part comes in contact with the inclined face and when the stopper member is turned from the protrusion posture into the restriction posture, the end edge of the base end part is guided along the inclined face toward the upstream side.

6. The image forming apparatus according to claim 5, wherein the stopper member has a bent part formed by bending the end portion on the downstream side of the base end part downward.

7. The image forming apparatus according to claim 1, wherein the second recess has a latch mechanism which has a projecting part projectable toward the upstream side and is alternatively switchable into a first state where the projecting part projects by a predetermined length and into a second state where the projecting part projects by a length longer than the predetermined length, by pushing the projecting part inward, wherein when the base end part is pressed downward and comes in contact with the projecting part, the projecting part is pushed in to switch the latch mechanism from the first state into the second state, and when the base end part is further pressed downward lower than the projecting part, the projecting part of the latch mechanism switched into the second posture pushes the base end part in the upstream side to turn the stopper member in the restriction posture.

8. An image forming apparatus comprising:

an ejection tray having a sheet stacking face on which an ejected sheet is stacked;

a storage part formed in the sheet stacking face; and a stopper member which has a base end part and a main part extending from the base end part toward a distal end of the stopper member, provided in the storage part turnably around a proximal end of the stopper member in upstream and downstream sides in a sheet ejection direction, the stopper member being selectively supported either in a storage posture stored in the storage part to form a part of the sheet stacking face by turning in the upstream side or a restriction posture to prevent the sheet from falling down from the sheet stacking face by turning in the downstream side, wherein the storage part includes a first recess; and a second recess connected to an end on the downstream side of the first recess with a step and having a depth deeper than a depth of the first recess, the base end part of the stopper member supported in the second recess so as to be movable upward and downward and turnable; and the main part of the stopper member extending from the base end part toward the distal end of the stopper member and supported in the first recess in the storage posture, wherein when the base end part is pressed downward in the storage posture, the base end part is moved downward in the second recess and a lower face of the main part comes into contact with an edge on the downstream side of the first recess, the stopper member is turned around the edge into a protrusion posture where the distal end protrudes above the sheet stacking face, wherein the second recess has a latch mechanism which has a projecting part projectable toward the upstream side and is alternatively switchable into a first state where the projecting part projects by a predetermined length and into a second state where the projecting part projects by a length longer than the predetermined length, by pushing the projecting part inward, wherein when the base end part is pressed downward and comes in contact with the projecting part, the projecting part is pushed in to switch the latch mechanism from the first state into the second state, and when the base end part is further pressed downward lower than the projecting part, the projecting part of the latch mechanism switched into the second posture pushes the base end part in the upstream side to turn the stopper member in the restriction posture.

9. The image forming apparatus according to claim 8, wherein the base end part of the stopper member has an engagement part, and the second recess of the storage part has an engaged part to which the engagement part is supported so as to be movable upward and downward and rotatable.

10. The image forming apparatus according to claim 8, wherein the base end part of the stopper member has an engagement part, and the second recess of the storage part has an engaged part to which the engagement part is supported so as to be movable upward and downward and rotatable.

* * * * *